US007758706B2

(12) United States Patent
Hirose et al.

(10) Patent No.: US 7,758,706 B2
(45) Date of Patent: Jul. 20, 2010

(54) METHOD FOR PRODUCING DUST CORE COMPACT AND DUST CORE COMPACT

(75) Inventors: Kazuhiro Hirose, Itami (JP); Haruhisa Toyoda, Itami (JP); Atsushi Sato, Osaka (JP); Takao Nishioka, Itami (JP); Yasuhiro Endo, Okazaki (JP); Ryoji Mizutani, Aichi (JP); Kazutaka Tatematsu, Toyota (JP); Kenji Harada, Aichi (JP)

(73) Assignees: Sumitomo Electric Industries, Ltd., Osaka (JP); Toyota Jidosha Kabushiki Kaisha, Aichi (JP)

( * ) Notice: Subject to any disclaimer, the term of this patent is extended or adjusted under 35 U.S.C. 154(b) by 597 days.

(21) Appl. No.: 11/663,305

(22) PCT Filed: Sep. 16, 2005

(86) PCT No.: PCT/JP2005/017126

§ 371 (c)(1),
(2), (4) Date: Mar. 21, 2007

(87) PCT Pub. No.: WO2006/033295

PCT Pub. Date: Mar. 30, 2006

(65) Prior Publication Data

US 2008/0102302 A1 May 1, 2008

(30) Foreign Application Priority Data

Sep. 21, 2004 (JP) ..... 2004-273522

(51) Int. Cl.
*H01F 1/22* (2006.01)
*H01F 1/24* (2006.01)

(52) U.S. Cl. ..... 148/104; 419/66; 75/228; 75/246

(58) Field of Classification Search ..... None
See application file for complete search history.

(56) References Cited

U.S. PATENT DOCUMENTS

| | | | | |
|---|---|---|---|---|
| 2002/0014280 | A1 * | 2/2002 | Moro | 148/104 |
| 2003/0206090 | A1 * | 11/2003 | Moro | 336/233 |
| 2004/0134566 | A1 | 7/2004 | Iyoda et al. | |

FOREIGN PATENT DOCUMENTS

| | | | |
|---|---|---|---|
| JP | 52-13409 | | 2/1977 |
| JP | 11-238614 | A | 8/1999 |
| JP | 2000-345213 | A | 12/2000 |
| JP | 2003-235186 | A | 8/2003 |
| JP | 2004-197212 | A | 7/2004 |

* cited by examiner

*Primary Examiner*—John P Sheehan
(74) *Attorney, Agent, or Firm*—McDermott Will & Emery LLP

(57) ABSTRACT

A method for producing a dust core compact includes the steps of forming a compact component by pressure-forming a soft magnetic powder having an average particle diameter Da under a pressure Pa, and forming a compact by pressure-forming a soft magnetic powder having an average particle diameter Db and the compact component under a pressure Pb. Average particle diameters Da and Db of the soft magnetic powders satisfy relationship Da/Db≧2, and pressures Pa and Pb applied during the pressure-forming satisfy relationship Pa/Pb≦½. With this structure, a method for producing a dust core compact exhibiting a high strength and capable of being fabricated even when it has a complex shape, and the dust core compact can be provided.

6 Claims, 5 Drawing Sheets

METHOD FOR PRODUCING DUST CORE COMPACT AND DUST CORE COMPACT

This application is the U.S. National Phase under 35 U.S.C. §371 of International Application No. PCT/JP2005/017126, filed on Sep. 16, 2005, which in turn claims the benefit of Japanese Application No. 2004-273522, filed on Sep. 21, 2004, the disclosures of which Applications are incorporated by reference herein.

TECHNICAL FIELD

The present invention generally relates to a method for producing a dust core compact, and the dust core compact. More particularly, the present invention relates to a method for producing a dust core compact fabricated using soft magnetic powder, and the dust core compact.

BACKGROUND ART

Conventionally, there has been known a method for producing an annular magneto coil by combining a plurality of magneto coil components in a circumferential direction. The production method is disclosed in Japanese Patent Laying-Open No. 2003-235186 (Patent Document 1).

According to the method for producing a magnetogenerator disclosed in Patent Document 1, a plurality of magneto coil elements having recesses and projections formed at coupling portions are coupled to each other by engaging the recesses and projections with each other. The obtained magneto coil is placed within a housing, and thereafter the housing is cooled down. Since the housing shrinks as it cools down, the magneto coil is shrink-fitted on the inner peripheral surface of the housing.

In addition, mechanical structures and electric/electronic components such as the magneto coil described above have been fabricated from a dust core compact obtained by pressure-molding soft magnetic powder filled into a mold.

Patent Document 1: Japanese Patent Laying-Open No. 2003-235186

DISCLOSURE OF THE INVENTION

Problems to be Solved by the Invention

However, according to the production method disclosed in Patent Document 1, since the magneto coil element formed of a magnetic material such as a magnetic steel sheet may be formed with variations in dimensional accuracy, a gap or excess stress may be generated at the coupling portion between the magneto coil elements when the plurality of magneto coil elements are shrink-fitted on the inner peripheral surface of the housing. The generation of a gap or excess stress causes deterioration in magnetic properties of the magneto coil.

Further, when an attempt is made to obtain a complex-shaped structure such as a magneto coil as a one-piece structure by means of pressure forming, sufficient molding pressure may not be applied to some positions within a mold. In this case, the obtained dust core compact has uneven density, and thus cannot achieve desired magnetic properties.

Although there can be conceived a method of molding a plurality of dust core compact components each having a shape of a divided piece of a complete product and thereafter coupling them together by shrink-fitting or screwing, the method also causes a problem similar to that in the production method disclosed in Patent Document 1.

Consequently, one object of the present invention is to solve the aforementioned problems, and to provide a method for producing a dust core compact exhibiting a high strength and capable of being fabricated even when it has a complex shape, as well as to provide the dust core compact.

Means for Solving the Problems

A method for producing a dust core compact includes the steps of: forming a compact component by pressure-forming a first soft magnetic powder having an average particle diameter Da under a pressure Pa; and forming a compact by pressure-forming a second soft magnetic powder having an average particle diameter Db and the compact component under a pressure Pb. Average particle diameter Da of the first soft magnetic powder and average particle diameter Db of the second soft magnetic powder satisfy relationship $Da/Db \geqq 2$. Pressures Pa and Pb applied during the pressure forming satisfy relationship $Pa/Pb \leqq 1/2$.

According to the method for producing a dust core compact configured as described above, a compact component is formed by subjecting the first soft magnetic powder to pressure forming (hereinafter also referred to as preparatory molding); and thereafter the compact component and the second soft magnetic powder are subjected to pressure forming (hereinafter also referred to as final molding) to mold the second soft magnetic powder and to bond the compact component and the second soft magnetic powder to obtain a compact. Therefore, even when the compact has a complex shape, the compact can easily be formed in that shape with even density.

On this occasion, since the preparatory molding is performed under relatively small pressure Pa satisfying the relationship $Pa/Pb \leqq 1/2$, the compact component is formed with a gap of a certain degree provided between particles of the first soft magnetic powder. Thereby, particles of the second soft magnetic powder can be introduced into the gap by performing the final molding under relatively large pressure Pb satisfying the above relationship. In addition, since the second soft magnetic powder has relatively small average particle diameter Db satisfying the relationship $Da/Db \geqq 2$, the particles of the second soft magnetic powder can easily be introduced into between the particles of the first soft magnetic powder. Consequently, the compact can be formed with the first and second soft magnetic powders intricately engaging with each other at a boundary position therebetween, thereby exhibiting excellent strength.

Preferably, the step of forming the compact component includes the step of forming the compact component by pressure-forming the first soft magnetic powder under pressure Pa of not more than 400 MPa. According to the method for producing a dust core compact configured as described above, the preparatory molding can be performed with a larger gap provided between the particles of the first soft magnetic powder. Thereby, the compact obtained by the final molding can exhibit a further improved strength.

Preferably, the step of forming the compact component includes the step of forming the compact component such that a surface thereof to be bonded to the second soft magnetic powder is shaped to have recesses and projections. According to the method for producing a dust core compact configured as described above, a contact area between the compact component and the second soft magnetic powder can be increased in the final molding. Thereby, the first and second soft magnetic powders can engage with each other more intricately, further improving the strength of the compact.

Further, the first and second soft magnetic powders each include a plurality of metal magnetic particles and an insulating coating film surrounding a surface of each of the plurality of metal magnetic particles. In the method for producing a dust core compact configured as described above, surfaces of the first and second soft magnetic powders are covered with the insulating coating film, and thus metal bonding between the particles cannot be attained when the pressure forming is performed. Consequently, the present invention, which improves the strength of the compact by the effect of physical engagement between the first magnetic powder and the second soft magnetic powder, can be utilized more effectively.

Preferably, the method for producing a dust core compact further includes the step of heat-treating the compact at a temperature of not less than 200° C. and not more than 500° C. after the step of forming the compact. According to the method for producing a dust core compact configured as described above, the heat treatment of the compact at a temperature of not less than 200° C. can eliminate an interface between the insulating coating films bonded to each other by the pressure forming, and thus the compact can exhibit a further improved strength. In addition, by setting the temperature for the heat treatment at not more than 500° C., insulation breakdown of the insulating coating film by heat can be suppressed. Thereby, the insulating coating film can sufficiently serve as an insulating layer between the metal magnetic particles.

A dust core compact according to the present invention is a dust core compact fabricated using any of the methods for producing a dust core compact described above. In the dust core compact, the particles constituting the second soft magnetic powder engage the particles constituting the first soft magnetic powder at a boundary position between the first soft magnetic powder and the second soft magnetic powder. According to the dust core compact configured as described above, the dust core compact has a structure in which the particles of the first and second soft magnetic powders engage with each other at the boundary position therebetween, and thus excellent bond strength can be achieved at that position.

Effects of the Invention

As described above, according to the present invention, a method for producing a dust core compact exhibiting a high strength and capable of being fabricated even when it has a complex shape, and the dust core compact can be provided.

DESCRIPTION OF THE REFERENCE SIGNS

Figure 1:
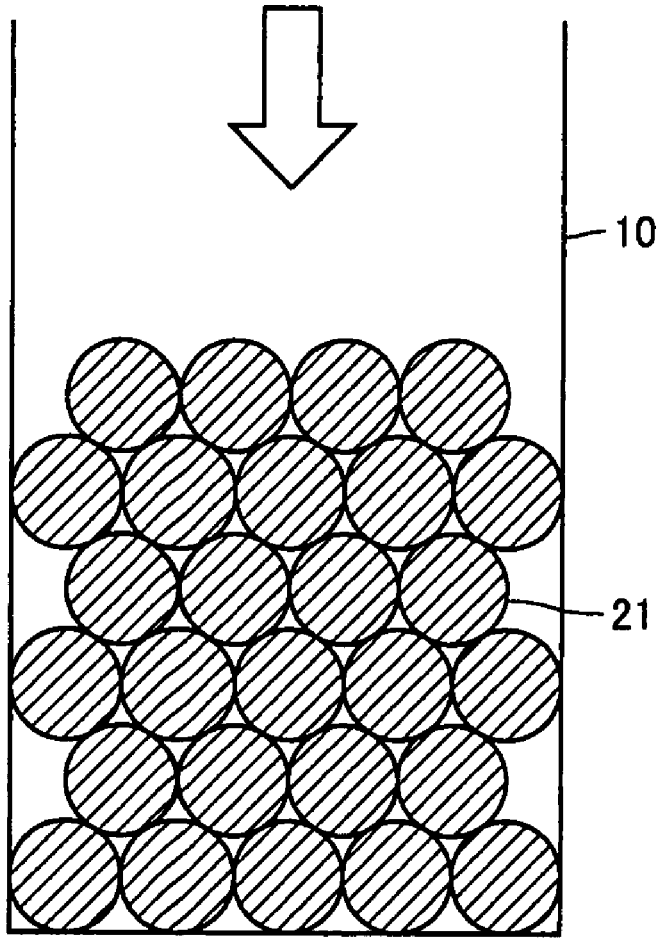
FIG. 1 is a schematic view showing a first step of a method for producing a dust core compact in a first embodiment of the present invention.

21, 31 soft magnetic powder, 22 compact component, 41 compact.

BEST MODES FOR CARRYING OUT THE INVENTION

Embodiments of the present invention will be described with reference to the drawings.

First Embodiment

FIGS. 1 to 6 are schematic views showing steps of a method for producing a dust core compact in a first embodiment of the present invention. In the drawings, the state of a soft magnetic powder in each step is shown schematically. Hereinafter, steps of fabricating a dust core using the method for producing a dust core compact in the present embodiment will be described.

Referring to FIG. 1, a soft magnetic powder 21, which is an aggregate of a plurality of soft magnetic particles (hereinafter also simply referred to as particles), is firstly prepared. The soft magnetic particle includes a metal magnetic particle and an insulating coating film surrounding the surface of the metal magnetic particle. Soft magnetic powder 21 has an average particle diameter Da. Soft magnetic powder 21 having such an average particle diameter can be obtained for example by classification using a sieve having an appropriate mesh size. It is to be noted that the average particle diameter described herein refers to a particle diameter obtained when the sum of masses of particles added in ascending order of particle diameter in a histogram of particle diameters measured by laser scattering and diffraction reaches 50% of the total mass, that is, a 50% particle diameter D.

The metal magnetic particle is made of, for example, iron (Fe), an iron (Fe)-silicon (Si) based alloy, an iron (Fe)-nitrogen (N) based alloy, an iron (Fe)-nickel (Ni) based alloy, an iron (Fe)-carbon (C) based alloy, an iron (Fe)-boron (B) based alloy, an iron (Fe)-cobalt (Co) based alloy, an iron (Fe)-phosphorus (P) based alloy, an iron (Fe)-nickel (Ni)-cobalt (Co) based alloy, and an iron (Fe)-aluminum (Al)-silicon (Si) based alloy. The metal magnetic particle may be made of a single metal, or may be an alloy.

The insulating coating film is formed by treating the metal magnetic particle with phosphoric acid. Further, the insulating coating film preferably contains an oxide. As the insulating coating film containing an oxide, an oxide insulator can be used, such as iron phosphate containing phosphorus and iron, manganese phosphate, zinc phosphate, calcium phosphate, silicon oxide, titanium oxide, aluminum oxide, or zirconia oxide. The insulating coating film may cover the metal magnetic particle in one layer, or in multiple layers.

The insulating coating film serves as an insulating layer between the metal magnetic particles. By covering the metal magnetic particle with the insulating coating film, the dust core to be obtained can have an increased electric resistivity ρ. This can suppress eddy current from flowing between the metal magnetic particles, and reduce core loss of the dust core due to occurrence of the eddy current.

Figure 2:
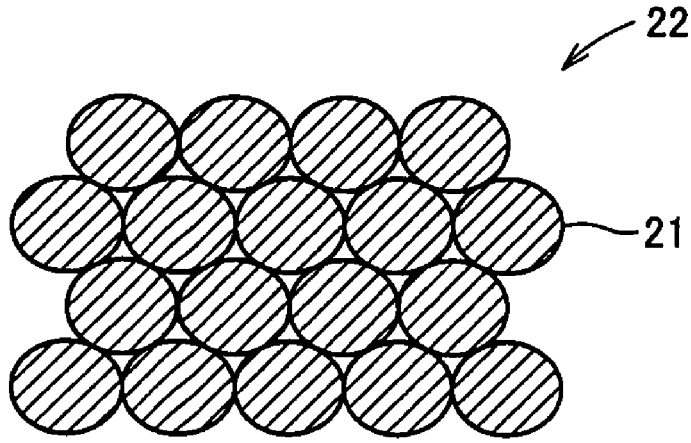
FIG. 2 is a schematic view showing a compact component obtained by the step shown in FIG. 1.

Next, prepared soft magnetic powder 21 is filled into a die 10 of a molding apparatus and pressure-formed under a pressure Pa (a preparatory molding step). On this occasion, pressure Pa is preferably not more than 400 MPa. Further, the pressure forming is preferably performed in an inert gas atmosphere or a reduced-pressure atmosphere, which can suppress soft magnetic powder 21 from being oxidized by oxygen in the atmosphere. Referring to FIG. 2, a compact component 22 is fabricated by the preparatory molding step described above. The shape of compact component 22 is changed as appropriate depending on the shape of a compact to be obtained finally in a subsequent step.

Figure 3:
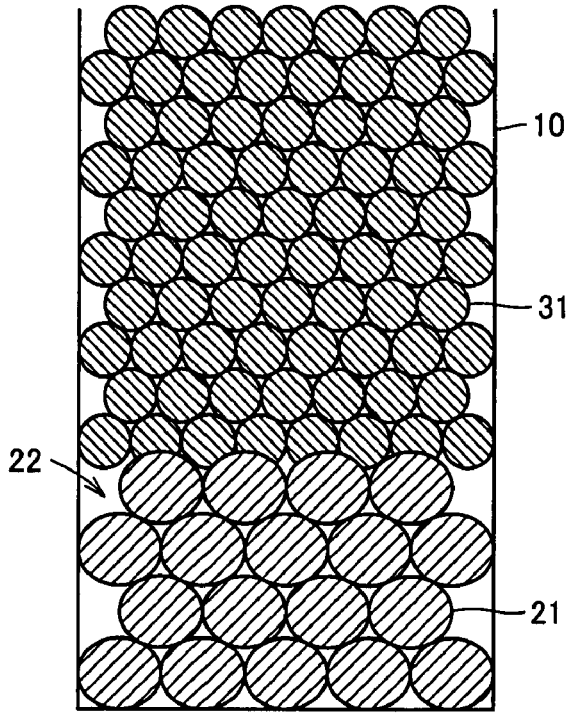
FIG. 3 is a schematic view showing a second step of the method for producing a dust core compact in the first embodiment of the present invention.

Referring to FIG. 3, a newly prepared soft magnetic powder 31 is then placed in die 10 of the molding apparatus, together with compact component 22 fabricated by the previous preparatory molding step. Soft magnetic powder 31 is similar in construction to soft magnetic powder 21 used in the preparatory molding step, and has an average particle diameter Db. Soft magnetic powder 31 having average particle diameter Db can be obtained by classification performed in the same way as in soft magnetic powder 21. The average particle diameter described herein also refers to 50% particle diameter D described above. Average particle diameter Da of soft magnetic powder 21 and average particle diameter Db of soft magnetic powder 31 satisfy relationship $Da/Db \geqq 2$.

Figure 4:
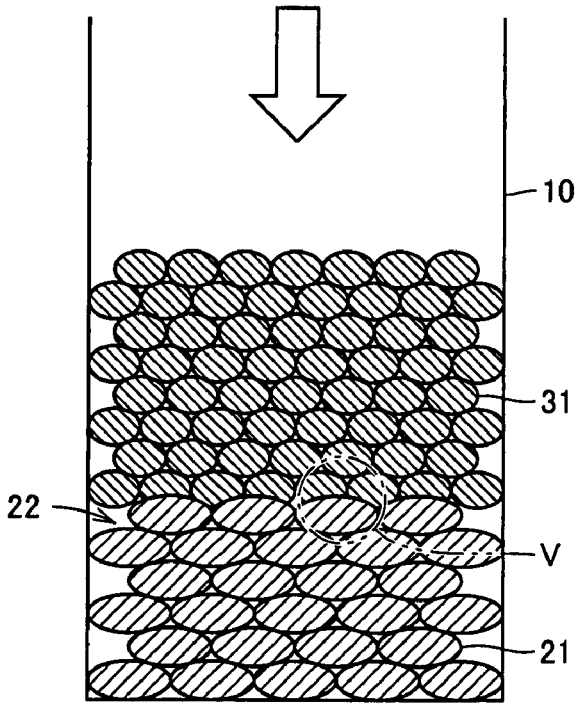
FIG. 4 is a schematic view showing a third step of the method for producing a dust core compact in the first embodiment of the present invention.

Referring to FIG. 4, compact component 22 and soft magnetic powder 31 placed in die 10 are then pressure-formed under a pressure Pb (a final molding step). Pressure Pa applied during the preparatory molding and pressure Pb applied during the final molding satisfy relationship $Pa/Pb \leqq ½$. Also in this molding step, the pressure forming is preferably performed in an inert gas atmosphere or a reduced-pressure atmosphere.

Figure 5:
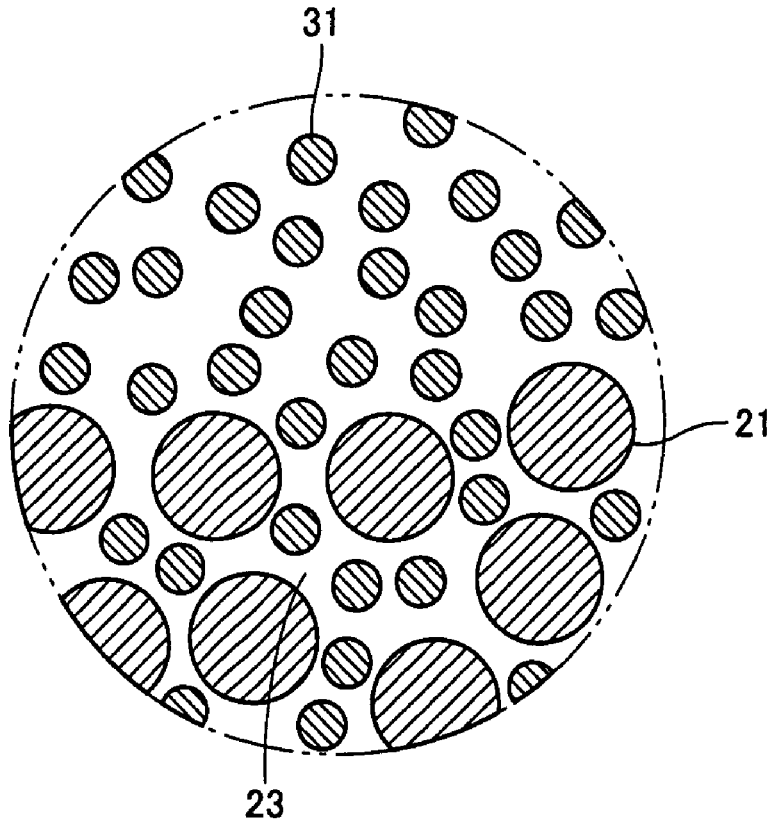
FIG. 5 is a schematic view showing an area surrounded by a two-dot chain line V in FIG. 4.

FIG. 5 schematically shows the state of the soft magnetic powders in the step shown in FIG. 4, in a representation different from FIG. 4. Referring to FIGS. 4 and 5, compact component 22 is molded with a gap 23 provided between the particles of soft magnetic powder 21, because pressure Pa applied during the preparatory molding is controlled, relative to pressure Pb applied during the final molding, to have a value satisfying the relationship $Pa/Pb \leqq ½$. Thereby, particles of soft magnetic powder 31 are introduced into gap 23 one after another when soft magnetic powder 31 is applied with pressure Pb during the final molding. On this occasion, since average particle diameter Da of soft magnetic powder 21 and average particle diameter Db of soft magnetic powder 31 satisfy the relationship $Da/Db \geqq 2$, soft magnetic powder 31 having relatively small average particle diameter Db can easily be introduced into gap 23 formed between the particles of soft magnetic powder 21 having relatively large average particle diameter Da.

Further, since pressure Pb satisfies the relationship described above relative to pressure Pa applied during the preparatory molding, the distance between the particles of soft magnetic powder 21 obtained by the preparatory molding is further reduced when the final molding is performed. Thereby, a junction location between compact component 22 and soft magnetic powder 31 can obtain a state where the particles of soft magnetic powders 21 and 31 intricately engage with each other.

Figure 6:
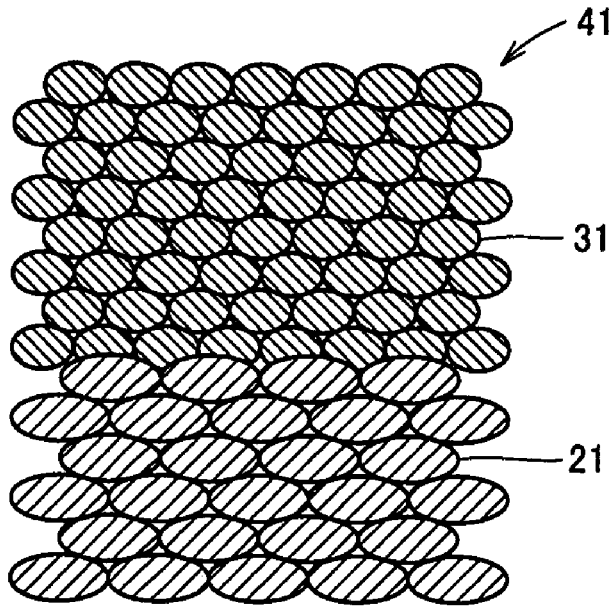
FIG. 6 is a schematic view showing a compact obtained by the step shown in FIG. 4.

Referring to FIG. 6, a compact 41 is fabricated by the final molding step described above. Thereafter, obtained compact 41 may be heat-treated at a temperature of not less than 200° C. and not more than 500° C. The heat treatment can soften the insulating coating film constituting compact 41 and eliminate an interface extending between adjacent insulating coating films. Thereby, the strength of compact 41 can be improved. Further, the heat treatment can reduce distortion generated inside compact 41 due to the pressure forming, and reduce hysteresis loss of the dust core to be obtained in a subsequent step. By setting the temperature for the heat treatment at not more than 500° C., the insulating coating film can be prevented from being deteriorated by heat. Thereby, the state where the metal magnetic particle is covered with the insulating layer can be maintained, and eddy current loss of the dust core to be obtained in a subsequent step can be reduced.

Finally, compact 41 is appropriately worked by such as extrusion, cutting, or the like, to be completed as the dust core.

The method for producing a dust core compact in the first embodiment of the present invention includes the steps of: forming compact component 22 by pressure-forming soft magnetic powder 21 as the first soft magnetic powder having average particle diameter Da under pressure Pa; and forming compact 41 by pressure-forming soft magnetic powder 31 as the second soft magnetic powder having average particle diameter Db and compact component 22 under pressure Pb. Average particle diameter Da of soft magnetic powder 21 and average particle diameter Db of soft magnetic powder 31 satisfy the relationship $Da/Db \geqq 2$. Pressures Pa and Pb applied during the pressure forming satisfy the relationship $Pa/Pb \leqq ½$.

According to the method for producing a dust core compact configured as described above, compact 41 having a final shape is fabricated by two molding steps, that is, the preparatory molding step and the final molding step. Therefore, even when compact 41 has a complex shape, that shape can easily be attained. Further, since compact 41 is fabricated by pressure-forming compact component 22 and soft magnetic powder 31 during the final molding, there is no need to use an adhesive or the like. Accordingly, compact 41 has no non-magnetic layer such as an adhesive therein, and thus a dust core having excellent magnetic properties can be obtained.

Further, by controlling the average particle diameters of soft magnetic powders 21 and 31 and the pressures applied during the preparatory molding and the final molding to satisfy appropriate relationships, the junction location between compact component 22 and soft magnetic powder 31 can obtain the state where the particles of soft magnetic powders 21 and 31 intricately engage with each other. Thereby, both powders are firmly bonded, and excellent bond strength can be achieved.

The method for producing a dust core compact in the present embodiment can be used to fabricate a dust core, a choke coil, a switching power supply element, a magnetic head, various types of motor components, a solenoid for automobile, various types of magnetic sensors and electromagnetic valves, and the like. Further, without being limited to these magnetic components, the method can also be used to subject such as iron powder having no insulating coating film to pressure forming to fabricate a mechanical component.

Second Embodiment

Figure 7:
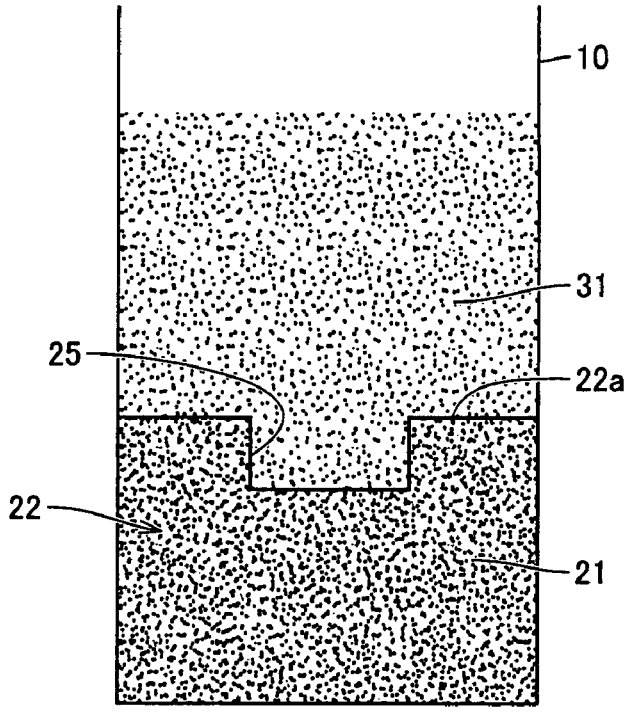
FIG. 7 is a cross sectional view showing a step of a method for producing a dust core compact in a second embodiment of the present invention.

FIG. 7 shows the step described in the first embodiment with reference to FIG. 3. A method for producing a dust core compact in the present embodiment has steps basically the same as those of the method for producing a dust core compact in the first embodiment. Hereinafter, description of the same step will not be repeated.

Referring to FIG. 7, in the present embodiment, a recess 25 is formed in a top surface 22*a* of compact component 22 in the preparatory molding step. Next, soft magnetic powder 31 is filled on top surface 22*a* having recess 25 formed therein, and the final molding step is performed under a predetermined pressure. In this case, since the contact area between soft magnetic powder 31 and compact component 22 is increased, compact 41 can be fabricated with soft magnetic powders 21 and 31 further engaging with each other. Thereby, the strength of compact 41 can further be improved.

Figure 8:
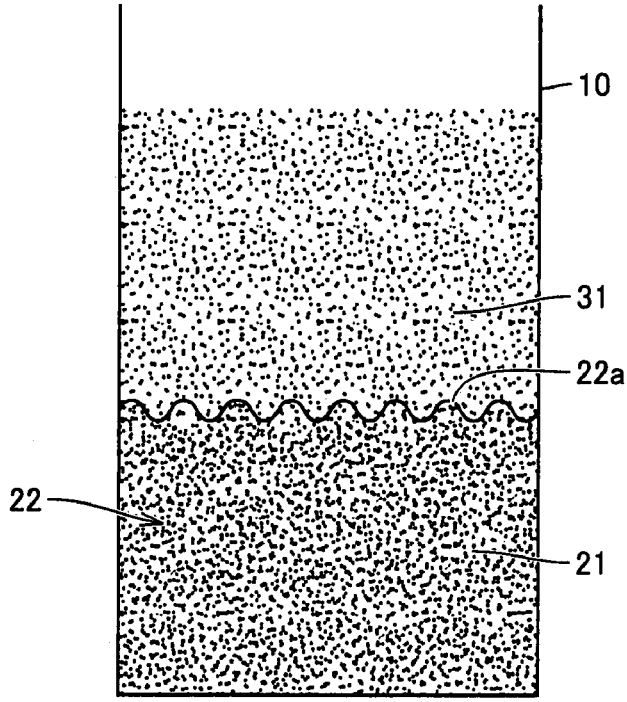
FIG. 8 is a cross sectional view showing a variation of the method for producing a dust core compact in the second embodiment of the present invention.

FIG. 8 shows a variation of the method for producing a dust core compact in the second embodiment of the present invention. Referring to FIG. 8, in this variation, entire top surface 22*a* of compact component 22 is formed to have recesses and projections in the preparatory molding step. Also in such a case, the same effect as the above can be obtained.

EXAMPLE

The method for producing a dust core compact in accordance with the present invention was evaluated by an example described below.

Iron powder coated with phosphate manufactured by Hoeganaes Japan K.K. (product name: "Somaloy 550", average particle diameter Da=265 μm) was prepared as soft magnetic powder 21. Further, iron powder coated with phosphate manufactured by Hoeganaes Japan K.K. (product name: "Somaloy 500", average particle diameter: 110 μm) was classified using sieves to prepare samples A to C of the iron powder coated with phosphate, having different average particle diameters, as soft magnetic powder 31. On this occasion, the classification was performed using sieves with a mesh size of 200 mesh, 147 mesh, and 80 mesh. Average particle diameters Db of samples A to C of the iron powder coated with phosphate were measured by laser scattering and diffraction, using Microtrac (manufactured by Nikkiso Co., Ltd.). Table 1 shows average particle diameter Db for each sample obtained by the measurement, and a value of Da/Db.

TABLE 1

| Sample No. | Average Particle Diameter Db (μm) | Average Particle Diameter Da/ Average Particle Diameter Db |
|---|---|---|
| A | 52 | 5.1 |
| B | 110 | 2.4 |
| C | 147 | 1.8 |

Next, the preparatory molding step and the final molding step were performed in accordance with the procedure described below, using a molding apparatus having a cylindrical pressurizing space with a diameter of 20 mm. Firstly, an appropriate die lubricant was applied on the inner wall of a die in the molding apparatus, and the iron powder coated with phosphate "Somaloy 550" as soft magnetic powder 21 was filled into the pressurizing space. Thereafter, pressure forming was performed with applied pressure Pa changed in the range between 1 ton/cm$^2$ and 12 ton/cm$^2$ to fabricate a plurality of compact components 22 molded under different applied pressures (the preparatory molding step).

Next, samples A to C of the iron powder coated with phosphate "Somaloy 500" as soft magnetic powder 31 were filled upon the obtained compact component 22. Thereafter, pressure forming was performed under applied pressure Pb of 12 ton/cm$^2$ to prepare compact 41 (the final molding step). On this occasion, there were some cases where bonding between compact component 22 and samples A to C of the iron powder coated with phosphate was not achieved depending on the combination thereof.

Further, iron powder manufactured by Hoeganaes Japan K.K. (product name: "ABC100. 30", average particle diameter Da=110 μm, having no insulating coating film) was prepared. This powder was also classified using sieves to prepare sample D of the iron powder as soft magnetic powder 21 and sample E of the iron powder as soft magnetic powder 31 having different particle diameters. On this occasion, sample D of the iron powder was obtained by the classification using a sieve with a mesh size of 115 mesh (124 μm), and sample E of the iron powder was obtained by the classification using a sieve with a mesh size of 200 mesh (74 μm). Average particle diameter Da of sample D of the iron powder and average particle diameter Db of sample E of the iron powder were measured by laser scattering and diffraction, using Microtrac (manufactured by Nikkiso Co., Ltd.). Table 2 shows average particle diameter Da of sample D and average particle diameter Db of sample E obtained by the measurement, along with a value of Da/Db.

TABLE 2

| Sample No. | Average Particle Diameter Da (μm) | Average Particle Diameter Db (μm) | Average Particle Diameter Da/ Average Particle Diameter Db |
|---|---|---|---|
| D | 138 | | 2.5 |
| E | | 58 | |

Next, the preparatory molding step described above was performed using sample D of the iron powder (average particle diameter Da=138 μm) prepared as soft magnetic powder 21 to fabricate a plurality of compact components 22 molded under different applied pressures. Further, the final molding step described above was performed using sample E of the iron powder (average particle diameter Db=58 μm) prepared as soft magnetic powder 31 to fabricate compact 41.

Figure 9:
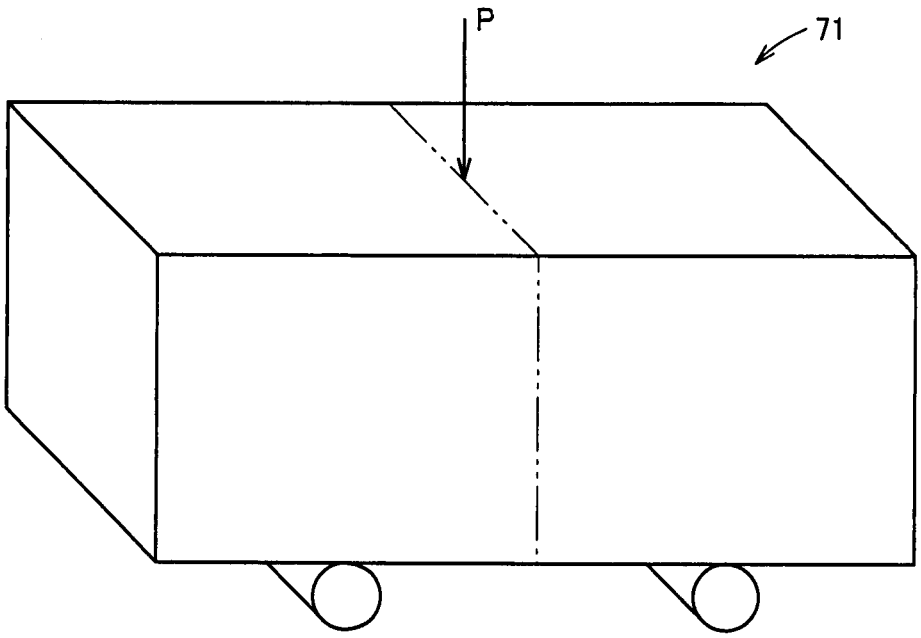
FIG. 9 is a perspective view showing a transverse test piece fabricated in an example.

FIG. 9 shows a transverse test piece fabricated in the example. Referring to FIG. 9, compact 41 was worked into a transverse test piece 71 with dimensions of 10 mm×10 mm×50 mm such that the position bonded by the final molding step is located at the center. Further, for comparison, the iron powder coated with phosphate "Somaloy 550" was molded into one piece under an applied pressure of 12 ton/cm$^2$, and then a transverse test piece having the same dimensions was fabricated from the obtained compact. Similarly, sample D of the iron powder (average particle diameter: 138 μm) was molded into one piece under an applied pressure of 12 ton/cm$^2$, and then a transverse test piece having the same dimensions was fabricated from the obtained compact. All of the fabricated transverse test pieces were heat-treated at 450° C. These transverse test pieces were supported with a span of 40 mm, and a load was applied to the central position of the transverse test piece in that condition. The transverse rupture strength of the transverse test piece was determined by measuring a stress value when the transverse test piece ruptured (a rupture stress value).

Figure 10:
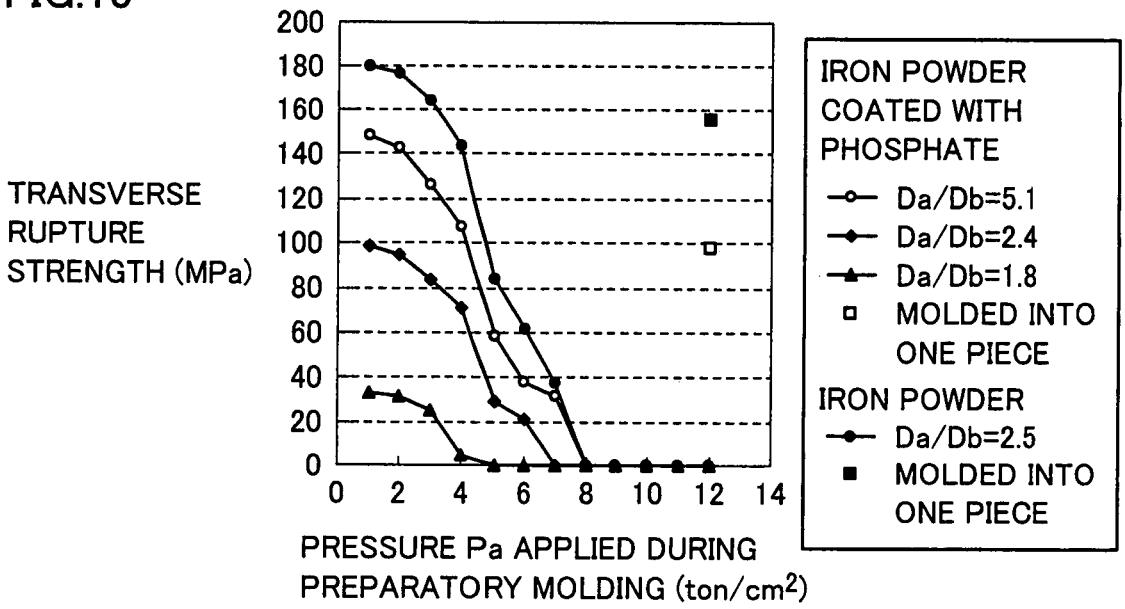
FIG. 10 is a graph showing relationship between pressure applied during preparatory molding and transverse rupture strength in the example.

FIG. 10 shows relationship between the pressure applied during the preparatory molding and the transverse rupture strength. It is to be noted that the traverse rupture strength was indicated as 0 when bonding was not achieved in the final molding.

As can be seen in FIG. 10, high traverse rupture strength was able to be obtained when the relationship Pa/Pb≦½ was satisfied, that is, when pressure Pa applied during the preparatory molding was not more than 6 ton/cm$^2$ and Da/Db was not less than 2. In particular, when pressure Pa applied during the preparatory molding was not more than 4 ton/cm$^2$ (≈400 MPa), compared with the transverse test piece molded into one piece, more than 80% of strength was obtained, exhibiting more excellent bond strength.

It should be understood that the disclosed embodiments and example above are, in all respects, by way of illustration only and are not by way of limitation. The scope of the present invention is set forth by the claims rather than the above description, and is intended to cover all the modifications within a spirit and scope equivalent to those of the claims.

INDUSTRIAL APPLICABILITY

The present invention is mainly utilized for manufacturing magnetic components such as a dust core, a choke coil, a switching power supply element, a magnetic head, various types of motor components, a solenoid for automobile, various types of magnetic sensors and electromagnetic valves, as well as manufacturing mechanical components.

The invention claimed is:

1. A method for producing a dust core compact, comprising the steps of:

forming a compact component by pressure-forming a first soft magnetic powder having an average particle diameter Da under a pressure Pa; and after said forming the compact component, forming a compact by pressure-forming a second soft magnetic powder having an average particle diameter Db and said compact component under a pressure Pb to mold said second soft magnetic powder and bond said second soft magnetic powder to said compact component, wherein the average particle diameter Da of said first soft magnetic powder and the average particle diameter Db of said second soft magnetic powder satisfy relationship Da/Db≧2, and said pressures Pa and Pb applied during the pressure forming satisfy relationship Pa/Pb≦½.

2. The method for producing a dust core compact according to claim 1, wherein the step of forming said compact component includes the step of forming said compact component by pressure-forming said first soft magnetic powder under the pressure Pa of not more than 400 MPa.

3. The method for producing a dust core compact according to claim 1, wherein the step of forming said compact component includes the step of forming said compact component such that a surface thereof to be bonded to said second soft magnetic powder is shaped to have recesses and projections.

4. The method for producing a dust core compact according to claim 1, wherein said first and second soft magnetic powders each include a plurality of metal magnetic particles and an insulating coating film surrounding a surface of each of said plurality of metal magnetic particles.

5. The method for producing a dust core compact according to claim 4, further comprising the step of heat-treating said compact at a temperature of not less than 200° C. and not more than 500° C. after the step of forming said compact.

6. A dust core compact fabricated using the method for producing a dust core compact according to claim 1, wherein particles constituting said second soft magnetic powder engage particles constituting said first soft magnetic powder at a boundary position between said first soft magnetic powder and said second soft magnetic powder.

* * * * *